United States Patent [19]

Hentschel

[11] Patent Number: 4,621,948

[45] Date of Patent: Nov. 11, 1986

[54] TUNNEL LINING FORM

[75] Inventor: Volker Hentschel, Dorsten, Fed. Rep. of Germany

[73] Assignee: Hochtief Ag Vorm. Gebruder Helfmann, Essen, Fed. Rep. of Germany

[21] Appl. No.: 673,775

[22] Filed: Nov. 21, 1984

[30] Foreign Application Priority Data

Nov. 23, 1983 [DE] Fed. Rep. of Germany ..... 3342220

[51] Int. Cl.[4] ..... E21D 9/06

[52] U.S. Cl. ..... 405/146; 405/238; 405/150

[58] Field of Search ..... 405/146, 156, 147, 150, 405/151, 138, 141; 299/31, 33

[56] References Cited

U.S. PATENT DOCUMENTS 3,483,706 12/1969 Taradash et al. ..... 405/152
3,561,223 2/1971 Tabor ..... 405/146 X
3,695,044 10/1972 Hoshino et al. ..... 405/152
3,707,846 1/1973 Leblond et al. ..... 405/152
3,818,710 6/1974 Chlumecky ..... 405/152
3,859,802 1/1975 Platner et al. ..... 405/152

FOREIGN PATENT DOCUMENTS 1203300 10/1965 Fed. Rep. of Germany .
2952744 12/1979 Fed. Rep. of Germany .

*Primary Examiner*—Dennis L. Taylor
*Attorney, Agent, or Firm*—Karl F. Ross; Herbert Dubno

[57] ABSTRACT

A tunnel casing is formed by cylindrical casing sections whose proximal flanges are not only bridged by the usual drawbolts tending to pull the casing sections toward one another, seals and centering elements, but also are provided with wedge or hydraulic spacers which can fix the gap widths at the respective joints by hydraulic or wedge blocking to take up pressure forces which cannot be sustained by the drawbolts.

11 Claims, 6 Drawing Figures

TUNNEL LINING FORM

FIELD OF THE INVENTION

My present invention relates to a lining of tunnels and, more particularly, to a falsework or form which can be assembled along a tunnel excavated in subterranean structures and adapted to have a concrete composition introduced between this form and the tunnel wall.

BACKGROUND OF THE INVENTION

Excavating machines for excavating tunnels can be provided with cylindrical shields which define an annular clearance with the excavated wall such that concrete or other sealing compositions can be introduced between the cylindrical shield and the wall. In this sense the shield forms a falsework or tunnel-lining form. Generally the forms are provided in sections and, after the concrete has hardened at a downstream end of the machine, the form section is removed and remounted at an upstream end of the lining which progresses in the forward direction.

The cylindrical elements can be referred to as lining elements, casings, and falsework, since generally they do not remain in place after the concrete is hardened, although one can contemplate circumstances under which the casings can remain.

In U.S. Pat. No. 4,436,448 and the corresponding German patent document No. 29 52 744, a tunnel-excavating machine utilizing the principles described and including such casing sections has been described.

As noted, the casing is formed from a number of casing sections which are disposed end to end and can be provided with centering elements for aligning each end substantially with an end of an adjoining casing element, drawbolts for securing the adjoining ends of these elements together, and sealing members which bridge the gaps between the casing elements to prevent incursion of the concrete or other aligning composition into the space surrounded by the casing elements.

The sealing elements must bridge various gap widths, depending upon the positioning of the casing elements.

While the casing elements can be composed of cast steel so as to have inwardly directed flanges or ribs at their ends and axially extending ribs bridging these flanges, in general the casing elements are composed of steel sheet or steel plate and are formed in a welded construction. In the latter case, the casing sections may be composed of segments in a casette type of structure.

The casing system with which the present invention is concerned is generally of use for the continuous placed-concrete method of lining the tunnel. In this method, as the excaving machine continues advancing through the tunnel, a casing or lining is assembled immediately behind the excavator and upstream of the previously emplaced lining sections.

The concrete is forced into the spaces between the lining sections or casing and the tunnel wall, the leading edge of the concrete being filled into a space behind a movable form member (forming part of the machine) which recedes as the concrete is pumped into the space.

In order to enable the straight casing sections to follow a curved path of the tunnel, the sections may be assembled so that the gap between them varies in width, depending upon the direction of curvature with a wedge shape. Depending upon the degree of the variation, various radii of the tunnel curves can be accommodated and depending upon the side which has the wider gap or the narrower gap, it is possible to allow the casing to follow practically any path contour which may be generated.

Depending upon the conformation of the path in space, the maximum width of the gap on one side of the casing and the corresponding minimum width at the diametrically opposite side of the casing can be determined.

In spite of the fact that gaps of various widths are required to allow the casing to assume the various curvatures necessary to follow the path of the tunnel, the gaps between the casing sections must be sealed off for a variety of reasons including the need to prevent incursion of the concrete introduced into the space around the casing. Another reason for the seals is that ground water must be excluded from the free space in the tunnel.

In addition, transverse and normal forces must be transferred by the casing sections, these forces being generated by a variety of sources. For example, they include the forces produced by the flowable concrete owing to local gravity or weight effects, local dynamic forces from the concrete pump pressure, the reaction forces by the fluid-operated cylinders which advance the excavator and the like. Centering and force-transmitting members are provided to additionally connect the casing elements. In conventional tunnel casings of the aforedescribed type, the bolts which draw the casing sections together also form the spacers or are provided with the spacers and also provide the means for taking up the forces mentioned above. They can be used to fix the width of the gap.

However, these systems are not able to withstand pressure forces so that if such axial pressure forces tending to compress the casings arise, either because of geological shift conditions or because of the way the excavator is operated, uncontrolled changes can occur in the relative positions of the individual casing elements.

To prevent this change, it is the practice to drive wood wedges into the gaps. This is a time-consuming and an expensive operation, in spite of the fact that it does not adequately secure the casing sections. Furthermore, such wedges can be removed only with considerable difficulty and thus impede the dismounting of an end section at the downstream end. Of course any wedges which are removed at this end must be reinserted when the casing section is again assembled onto the upstream end.

In the latter patent and the corresponding German patent document, there is described a hydraulic piston-and-cylinder connection between cylindrical shield sections of a tunneling machine, although not between falsework sections in place of the drawbolts or tension-screw arrangements hitherto used effectively, this arrangement links successive shield sections together.

The connecting piston-cylinder elements are generally of the double-acting type and can be operated in an active or passive mode, as desired. When they operate in an active mode, they can be individually controllable so that one shield section can be actively shifted as to its orientation and spacing with respect to the other.

When, however, a passive mode is desired, the connecting piston-cylinder arrangements can be interconnected in parallel and connected to a closed hydraulic network so that one shield section can be adjusted relative to the other in a passive manner.

Similarly one can make use of a tunnel excavator in which the shield sections are additionally connected together via an articulation or joint as in German patent document-printed application DE-AS No. 12 03 300.

In this manner manual adjustment of the individual drawbolts of the classical construction can be avoided.

While tunneling machines thus have been improved according to the principles of U.S. Pat. No. 4,436,448, as far as I am aware, they have not influenced the field of replaceable or assemblable tunnel linings or casings, possibly because the connecting piston-cylinder arrangements do not allow simple removal, replacement, mounting or adjustment of the individual casing sections.

OBJECTS OF THE INVENTION

It is, therefore, the principal object of the present invention to provide a tunnel-casing system of the aforedescribed type, i.e. in which removable and replaceable casing sections are connected end to end, whereby the disadvantages of earlier tunnel-casing systems are obviated and, especially, the gaps between the casing sections can be fixed against compressive forces in a significantly improved manner.

Another object of this invention is to provide a casing assembly which has a more effective ability to withstand the axial compressive forces and yet allows casing sections to be dismounted and remounted with ease.

SUMMARY OF THE INVENTION

These objects and others which will become apparent hereinafter are attained, in accordance with the invention, in a tunnel lining or casing which comprises a plurality of generally cylindrical casing sections which are disposed in end-to-end relationship, can define a clearance with the tunnel wall which can be filled with concrete or some other hardenable composition, and which define joints at their proximal extremities which are closed by respective seals and can have varying gap widths, the proximal ends of the sections, i.e. the ends which approach to form a respective gap, being further interconnected by angularly spaced drawbolts which can traverse the annular flanges extending inwardly on each casing section at the respective end thereof. According to the invention, additional adjustable spacer pressure elements are angularly equispaced around the peripheries of the casing sections or rings and span the width of the gap, being so constructed that they can be blocked in given spacing settings to maintain the predetermined gap width at each of the locations of these pressure spacers around the periphery of the ring.

In other words, the spacers are adjustable as to the spacings they establish, are pressure resistant, i.e. can be blocked to prevent reduction of the spacing once set, and preferably are carried by one of the flanges of one ring to bear against the other flange of the other ring, although both of the proximal flanges can be provided with such spacers and the spacers of the two rings can be angularly offset from one another.

According to an important feature of the invention, each of the spacers is a hydraulic piston-and-cylinder arrangement and all of the piston-and-cylinder units can be connected at the respective end of the casing section by a ring duct or pipe enabling each spacing setting to be adjusted or established and the respective spacer to be blocked in its setting by valves individually or blocked in settings in groups by such valves. Hydraulic blocking of the spacers can be effected simply by preventing escape of fluid from the respective cylinders.

The piston-and-cylinder arrangements can form part of a passive closed hydraulic system or an active hydraulic system as disclosed in the aforementioned U.S. Pat. and German patent document No. 29 52 744.

According to another feature of the invention, the adjustable and blockable spacers, capable of withstanding pressure and hence referred to as compression spacers as will be described below, can be wedge units having wedge surfaces in an X pattern with each of the casing flanges provided with a respective spacing wedge, and movable wedge members oriented so that they can be drawn together or moved apart to establish the respective gap spacings. The movement can be imparted by a spindle having a thread and which can be threaded into at least one of the movable wedge elements serving for adjustment and blocking of the spacer.

The compression spacers can be mounted in or on the casing flanges and I can also provide double-acting piston-and-cylinder arrangements angularly equispaced around the peripheries of the casing rings and so connected to a pump that the various gap spacings and hence the relative orientations of the casing sections can be adjusted.

The tunnel lining or casing of the invention has the advantage that the gap widths which can vary between each pair of casing sections or rings, can be fixed conveniently and easily and will withstand the pressure forces which have heretofore altered the gap spacings and have resulted in shifting of adjacent casing elements. Apart from the compression spacers, the conventional drawbolts and like casing structures, including the conventional casing seals can be utilized without significant modification.

BRIEF DESCRIPTION OF THE DRAWING

The above and other objects, features and advantages of the present invention will become more readily apparent from the following description, reference being made to the accompanying drawings in which.

SPECIFIC DESCRIPTION

Figure 1:
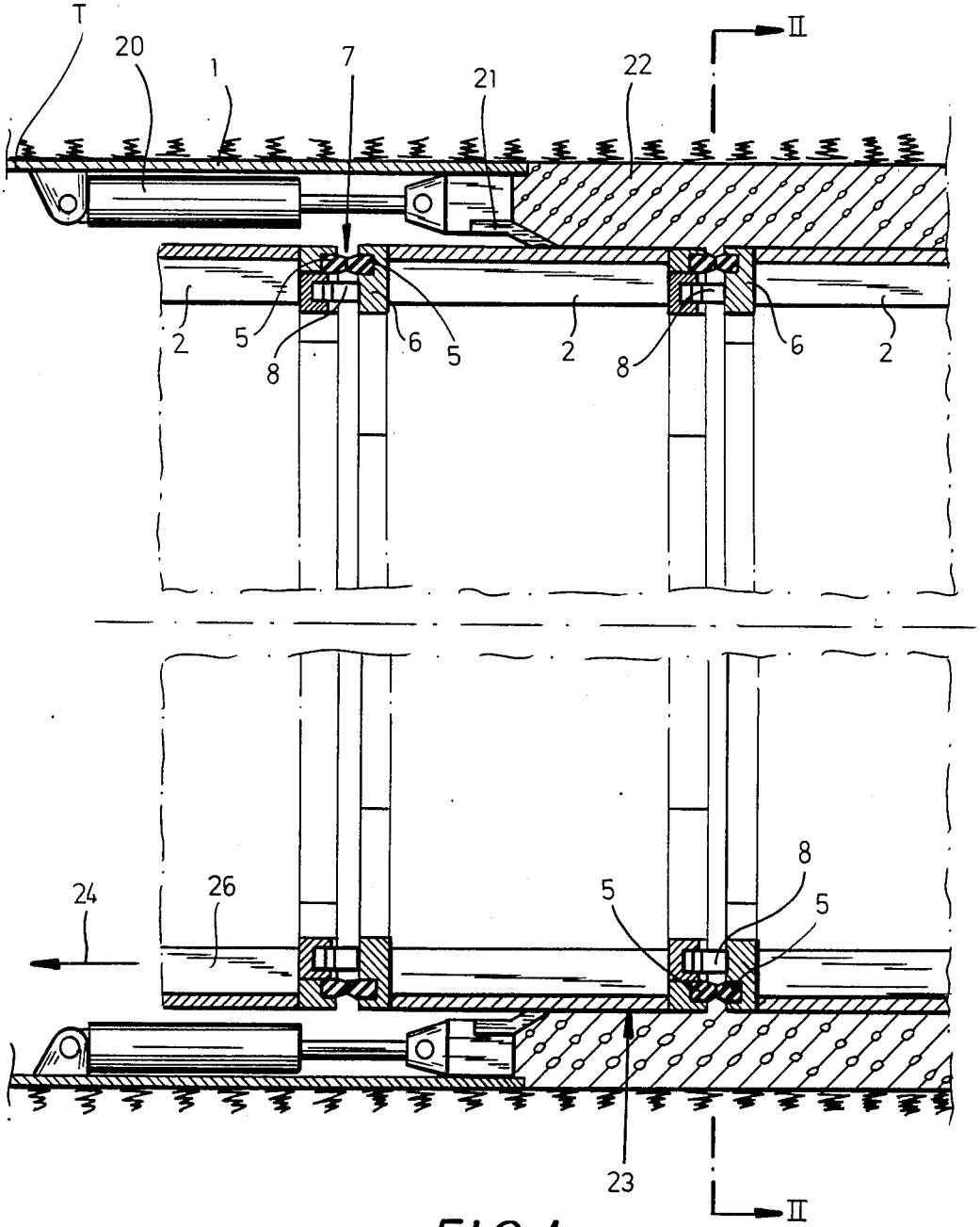
FIG. 1 is an axial section through a portion of a tunnel provided with a tunnel lining in accordance with the invention.
Figure 2:
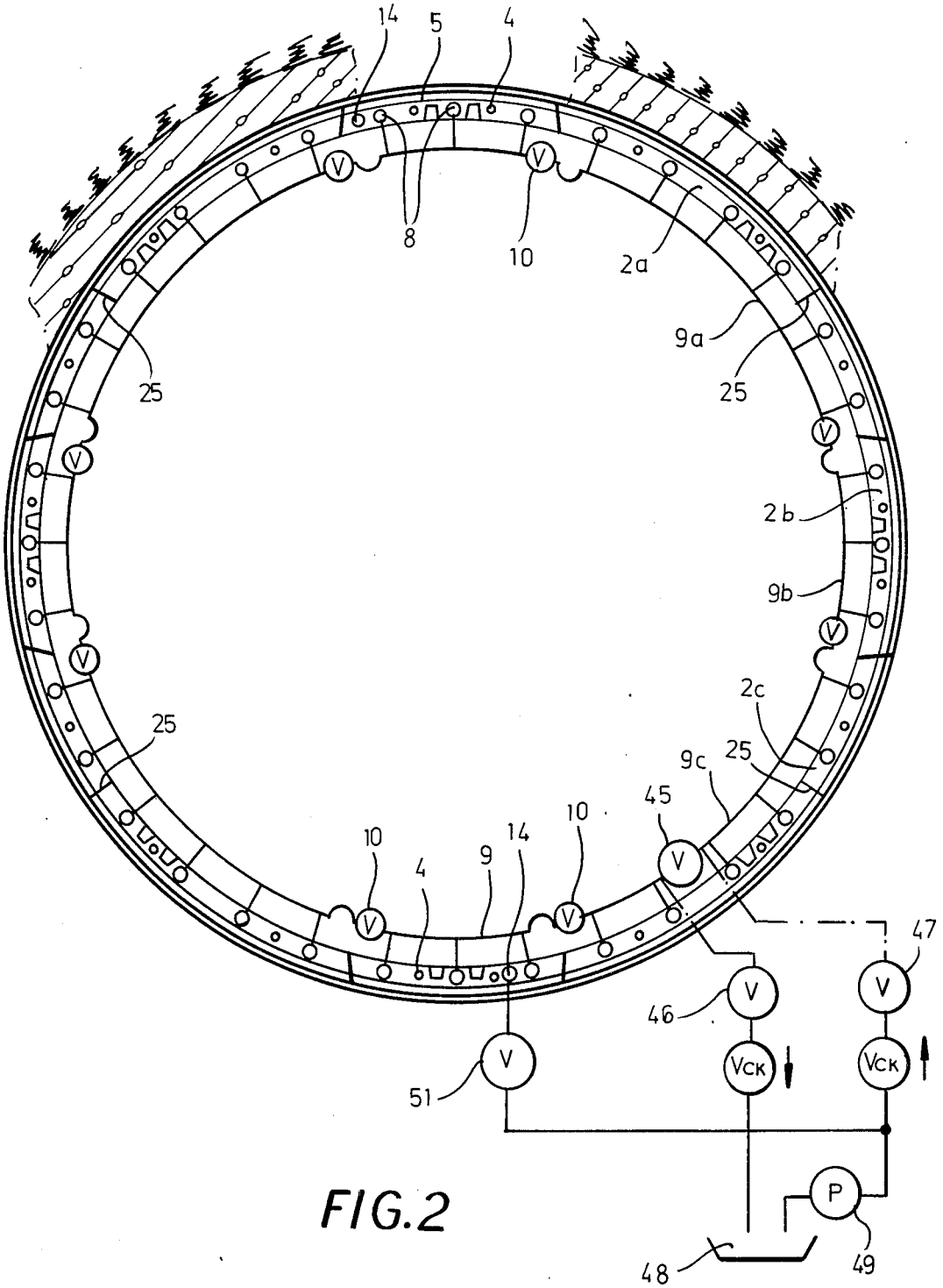
FIG. 2 is a section taken along the line II—II of FIG. 1.

From FIGS. 1 and 2, which are highly diagrammatic in nature, it can be seen that a tunnel wall T can be formed by a tunneling machine of which only the trailing end has been illustrated and is shown at 1. The tunneling machine is equipped with a hydraulic arrangement 20 adapted to move a shield 21 as concrete 22 is pumped into place around the casing 23 and between this casing and the tunnel wall T.

The tunneling machine moves continuously to the left as represented by the arrow 24 and behind the tunneling maching and at the downstream side of the casing with respect to the direction of advance, additional casing sections or casing rings 2 are added.

The casing rings 2 may, in turn, at joints 25 (FIG. 2) form segments, and can have axially extending ribs 26 which are welded to and braced against the flanges 6 extending inwardly at each end of each ring 2.

Figure 4:
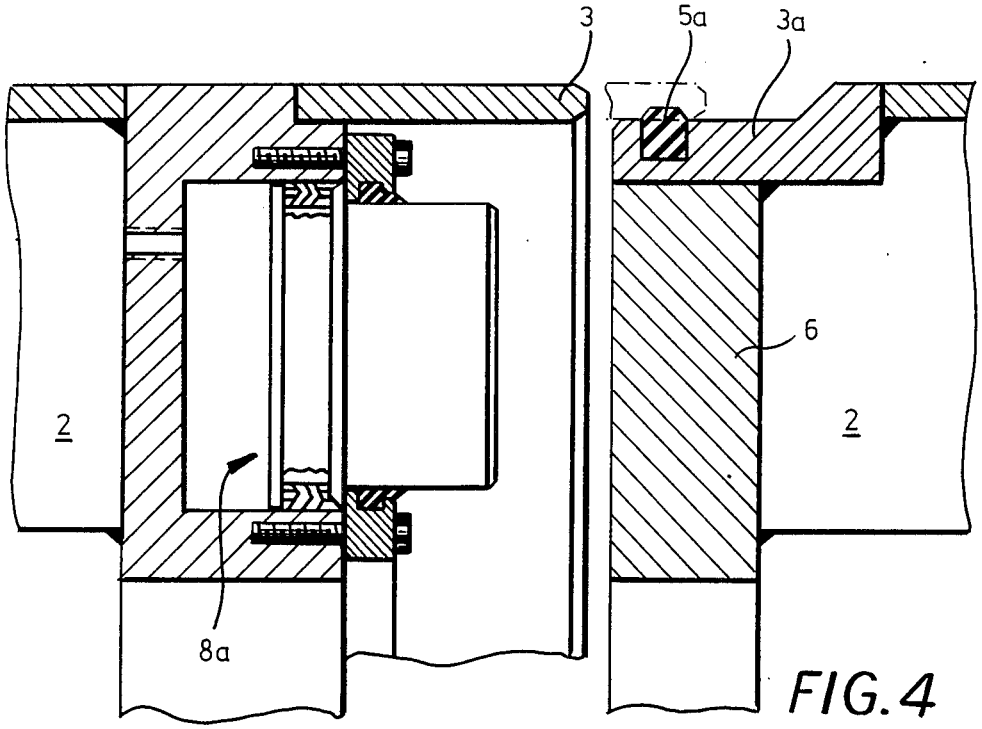
FIG. 4 is a view similar to FIG. 3 showing another embodiment thereof.

To join the casing rings 2 in end-to-end relationship, centering elements 3 can be provided as shown in FIG. 4 or these centering elements can be formed by drawbolts 4 which are angularly equispaced around the ring. Drawbolts are shown in greater detail in FIG. 5 and only in section in FIG. 2. Although present, they are not visible in FIG. 1.

Each drawbolt 4 can have a head 27 braced against one flange 6 (FIG. 5), a shank 28 passing through both proximal flanges 6 at each gap or joint 7, and a nut 29 which is threaded onto the opposite end of the bolt and braces on compression spring 30 via a washer 31 against the second flange. It will be apparent that the drawbolts act only in traction and would tend to allow the spacing to diminish if the joint was placed in compression in the absence of compression spacers as will be described.

When centering is not provided by the bolts or when additional centering is desired, it is advantageous to utilize an apron such as has been shown at 3 in FIG. 4 which slides over a ring 3*a* and can engage a seal 5*a* forming the sealing element for the gap.

Figure 5:
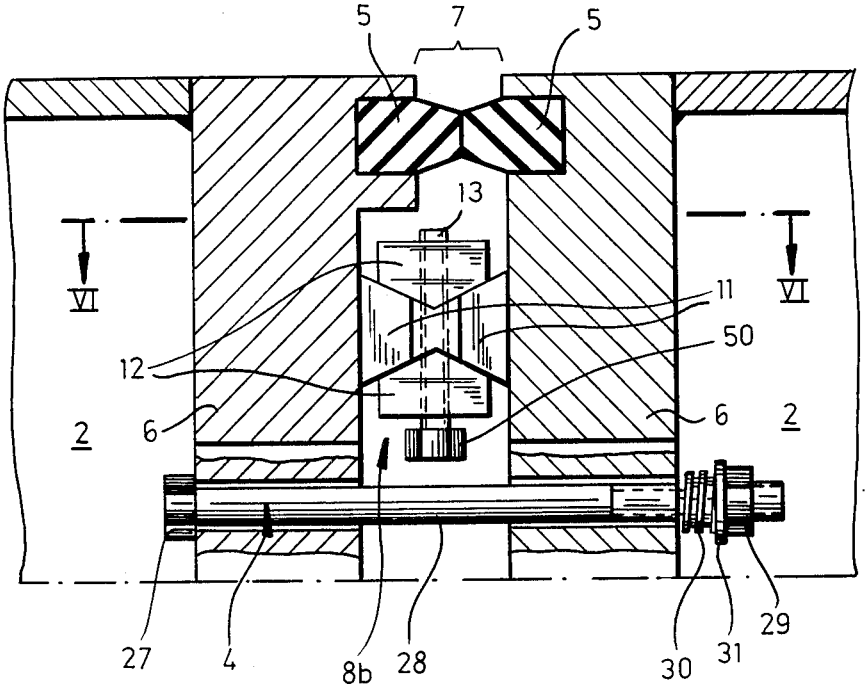
FIG. 5 is still another view similar to FIG. 3 illustrating a variant of the hydraulic systems of FIGS. 3 and 4.
Figure 6:
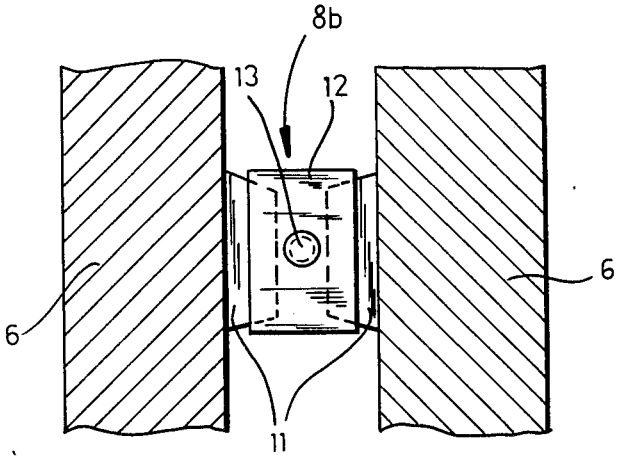
FIG. 6 is a section taken along the line VI—VI of FIG. 5.

In all cases some kind of seal is provided for the gap as has been shown at 5*a* in FIG. 4 and as is also formed by a pair of sealing rings 5 in the remaining embodiments. As can be seen from FIG. 3 and 5, for example, respective sealing rings 5 can be seated in grooves 32 formed in the confronting flanges 6 and can be braced against one another (FIGS. 1 and 5).

The seals 5 are resilient so that they can accommodate varying widths of the gap 7 withing limits. The seals 5, 5*a* thus seal these gaps and prevent ground water or concrete from entering the tunnel space enclosed by the shells or rings.

According to the invention, between the casing ring flanges 6, compression spacers 8 are disposed in angularly equispaced relationship. The compression spacers 8 are designed to bridge the gap between the flanges and, upon hydraulic blocking, can prevent variation in the gap width or spacing.

Figure 3:
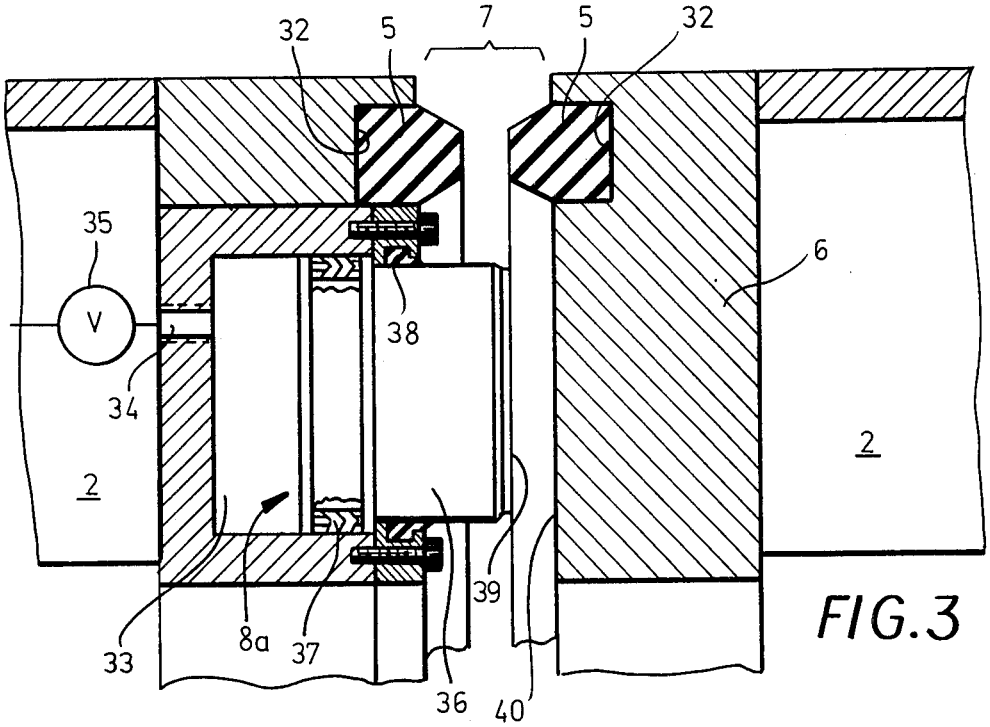
FIG. 3 is an enlarged section showing a detail of a joint which can be made between two casing sections in accordance with one embodiment of the invention.

In FIGS. 3 and 4, for example, the compression spacers 8 are formed by hydraulic piston-and-cylinder arrangements 8*a*, each of which is equipped with a cylinder 33 welded into an opening in the respective flange 6 and provided with a bore 34 which can be connected to a valve 35 individual to this sealing or to a group of such cylinders. The piston 36 of each hydraulic unit 8*a* carries a seal 37 sliding within the cylinder 33 and is also sealed against the exterior at 38. A free end 39 of the piston is adapted to brace against the surface 40 of the opposing flange.

The hydraulic piston-and-cylinder units 8*a* can be connected to a common ring duct or pipe 9 shown diagrammatically in FIG. 2 and additional or group valves 10 can be provided along the annular duct to allow blocking of groups of cylinders when their individual valves are open. When the duct 9 forms a closed annulus as shown in solid lines in FIG. 2, it forms a passive closed hydraulic system with a fixed amount of fluid. Alternatively, a valve 45 can be provided which can interrupt the closed system and connect opposite ends of it via valves 46 and 47 to an active hydraulic system represented by the reservoir 48 and the pump 49. Individual cylinders can be connected to the same active system by respective pumps if desired.

In the embodiment of FIG. 5, the compression spacer 8 is formed as a wedge assembly 8*b* with the wedges 11 and 12 being provided an an X pattern. The wedges 11 can be mounted on the flanges 6 and can cooperate with a pair of wedges 12 which are moved toward one another and hence are referred to as adjusting and blocking wedges. The wedges 12 are threadedly engaged by opposite-hand threads of a threaded spindle 13 whose head 50 can be rotated by the worker with an appropriate tool.

As noted, when the hydraulic units are provided, they can be disposed on only one of the flanges 6 of each joint or on both of the flanges, facing in opposite directions and offset from one another. The piston-and-cylinder arrangements can also be double-acting and disposed so as to provide the drawing function of pulling the two flanges together as well as holding them apart.

The spacers 8 in the embodiment shown, act as combined pressure force-transmitting units and spacers fixing the width of the gap 7 and can be relaxed without difficulty. The stroke of each spacer should correspond to the maximum width of the gap 7 corresponding to the desired minimum radius of curvature of the tunnel axis. The ring duct 9 can be provided into sections 9*a*, 9*b*, 9*c* which are interconnected by quick-connect couplings which may each be associated with the respective ring segments 2*a*, 2*b*, 2*c* . . . .

The doubling-acting piston-and-cylinder units which are used to orient the casing rings or elements can be constructed as described in the aforementioned U.S. patent and have been shown at 14 in FIG. 2. These units are angularly equispaced about the rings and are connected by valves 51 to the pump 49.

I claim:

1. In combination with a tunneling machine which excavates a tunnel in a subterranean structure and provided with means for lining a wall of the tunnel immediately beind the machine with concrete, a removable tunnel casing adapted to be emplaced behind said machine to define a space with said wall to be filled with concrete, said casing commprising:

a plurality of removable segmented generally cylindrical tunnel casing sections disposed substantially in axially end-to-end relation and formed with respective annular flanges at the axial ends of said sections whereby proximal flanges of successive casing sections define the respective joint forming a gap with a variable gap width, said casing sections being removably disposed in said tunnel such that a section can be moved from an upstream end of the casing to a location immediately behind said machine;

sealing means on at least one of said casing sections at each of said joints for sealing the respective gap against incursion from the direction of a tunnel wall;

respective drawbolts angularly spaced at each of said joints for drawing the proximal flanges thereof toward one another to varying distances depending upon the path of the tunnel; and angularly equispaced compression spacers disposed between and axially bridging the proximal flanges at each joint for variably establishing respective spacings between said proximal flanges at the respective spacers and between portions of the proximal flanges and being blockable to maintain the said spacing under compression forces whereby the progressive advance of the casing through said tunnel permits the casing to be oriented to tunnel curves with said sections and being blockable to maintain the said spacing under compression forces.

2. The tunnel casing defined in claim 1 wherein said spacers are hydraulic piston-and-cylinder units.

3. The tunnel casing defined in claim 2 wherein said units are provided with valves individual thereto for hydraulically blocking them.

4. The tunnel casing defined in claim 2 wherein a group of said units for each joint is provided with a common valve for hydraulically blocking all of the units of the respective group.

5. The tunnel casing defined in claim 2, further comprising a ring duct communicating with all of said units to a given joint.

6. The tunnel casing defined in claim 2 wherein said units form part of a closed passive hydraulic system for each joint.

7. The tunnel casing defined in claim 2, further comprising means for connecting said units to a pump forming part of an active hydraulic system for the units of each joint.

8. The tunnel casing defined in claim 1 wherein said spacers are wedge assemblies having wedges in an X pattern.

9. The tunnel casing defined in claim 8 wherein each of the proximal flanges is provided with a respective one of said wedges and said assembly includes a further pair of wedges engaging the first mentioned wedges, and a spindle engaging the wedges of said further pair with threads of opposite hand and rotatable to draw said further wedges together and urge them apart.

10. The tunnel casing defined in claim 1 wherein said spacers are mounted in at least one of the proximal flanges of each joint.

11. The tunnel casing defined in claim 1, further comprising a plurality of double-acting piston-and-cylinder units connected to a pump and angularly equispaced around said elements for orienting said elements with respect to one another.

* * * * *